US007488394B2

(12) United States Patent
Nakamura et al.

(10) Patent No.: US 7,488,394 B2
(45) **Date of Patent: *Feb. 10, 2009**

(54) RARE EARTH PERMANENT MAGNET

(75) Inventors: Hajime Nakamura, Echizen (JP); Koichi Hirota, Echizen (JP); Masanobu Shimao, Echizen (JP); Takehisa Minowa, Echizen (JP)

(73) Assignee: Shin-Etsu Chemical Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/340,502

(22) Filed: Jan. 27, 2006

(65) Prior Publication Data

US 2006/0213584 A1 Sep. 28, 2006

(30) Foreign Application Priority Data

Mar. 23, 2005 (JP) ..... 2005-084213

(51) Int. Cl.
*H01F 1/057* (2006.01)
*H01F 1/058* (2006.01)

(52) U.S. Cl. ..... 148/302; 148/301; 75/232; 75/236; 75/244

(58) Field of Classification Search ..... None
See application file for complete search history.

(56) References Cited

U.S. PATENT DOCUMENTS 5,194,099 A * 3/1993 Esper et al. ..... 148/302
5,411,603 A * 5/1995 Vial et al. ..... 148/101
5,766,372 A * 6/1998 Fujimura et al. ..... 148/101
5,858,124 A * 1/1999 Endo et al. ..... 148/302
6,296,720 B1 * 10/2001 Yamamoto et al. ..... 148/302
6,302,939 B1 * 10/2001 Rabin et al. ..... 75/338
6,960,240 B2 * 11/2005 Hirota et al. ..... 75/610
7,053,745 B2 * 5/2006 Yoshimura et al. ..... 335/302
2004/0187970 A1 * 9/2004 Ishizaka et al. ..... 148/302

FOREIGN PATENT DOCUMENTS

EP 1 830 371 A1 9/2007
JP 61-195954 * 8/1986
JP 1-251704 * 10/1989
JP 3-188241 * 8/1991
JP 4-184901 * 7/1992

(Continued)

OTHER PUBLICATIONS

Machine Transaltionof Japanese Patent Document 06-244011.*

(Continued)

*Primary Examiner*—John P Sheehan
(74) *Attorney, Agent, or Firm*—Westerman, Hattori, Daniels & Adrian, LLP.

(57) ABSTRACT

A rare earth permanent magnet is in the form of a sintered magnet body having a composition $R^1{}_aR^2{}_bT_cA_dF_eO_fM_g$ wherein F and $R^2$ are distributed such that their concentration increases on the average from the center toward the surface of the magnet body, and grain boundaries having a concentration of $R^2/(R^1+R^2)$ which is on the average higher than the concentration of $R^2/(R^1+R^2)$ contained in primary phase grains of $(R^1,R^2)_2T_{14}A$ tetragonal system form a three-dimensional network structure which is continuous from the magnet body surface to a depth of at least 10 μm. The invention provides R—Fe—B sintered magnets which exhibit a high coercive force.

6 Claims, 1 Drawing Sheet

FOREIGN PATENT DOCUMENTS

| | | | | |
|---|---|---|---|---|
| JP | 4-328804 | | * | 11/1992 |
| JP | 5-31807 | | * | 5/1993 |
| JP | 6-244011 | | * | 9/1994 |
| JP | 6-244011 | A1 | | 9/1994 |
| JP | 3143156 | | * | 3/2001 |
| JP | 3471876 | | | 9/2003 |
| JP | 2003-282312 | | | 10/2003 |
| JP | 2004-304038 | | | 10/2004 |
| JP | 2005-11973 | | | 1/2005 |
| WO | 2004-114333 | A1 | | 12/2004 |
| WO | WO 2005/123974 | A1 | * | 12/2005 |

OTHER PUBLICATIONS

K. T. Park et al.; "Effect of Metal-Coating and Consecutive Heat Treatment of Coercivity of Thin Nd-Fe-B Sintered Magnets", Proceedings of the Sixteenth International Workshop on Rare-Earth Magnets and Their Applications, The Japan Institute of Metals, 2000, pp. 257-264. Cited in the specification.

The Journal of the Institute of Electrical Engineers of Japan, vol. 124, 2004, pp. 699-702, published on Nov. 1, 2004.

Press Release (Shin-Etsu News) dated on Mar. 24, 2005.

Intermag Asia 2005; Digest of the IEEE International Magnetics Conference; p. 476; held on Apr. 4-8, 2005.

Techno-Frontier Symposium 2005; pp. B1-2-1 to B1-2-12; held on Apr. 20, 2005 by JMA.

IEEE Transactions on Magnetics, vol. 41, No. 10. Oct. 2005, pp. 3844-3846.

Hwang D. H. et al. "Development of High Coercive Powder From the Nd-Fe-B Sintered Magnet Scrap" IEEE Transactions on Magnetics, IEEE Service Center, New York, NY, US, vol. 40, No. 4, Jul. 2004, pp. 2877-2879.

K Hirota H Nakamura T Minowa M Honshima: "Coercivity Enhancement by Grain Boundary Diffusion Process to Nd-Fe-B Sintered Magnets" IEEE Transactions on Magnetics, vol. 42, No. 10, 2006, pp. 2909-2911.

H Nakamura, K Hirota M Shimao T Minowa M Honshima: "Magnetic Properties of Extremely Small Nd-Fe-B Sintered Magnets" IEEE Transactions on Magnets, vol. 41, No. 10, 2005, pp. 3844-3846.

Extended European Search Report dated Jan. 16, 2008 of European Application No. 06250543.3.

The Journal of the Institute of Electrical Engineers of Japan, vol. 124, 2004, pp. 699-702, published on Nov. 1, 2004.

Press Release (Shin-Etsu News) dated on Mar. 24, 2005.

Intermag Asia 2005; Digest of the IEEE International Magnetics Conference; p. 476; held on Apr. 4-8, 2005.

Techno-Frontier Symposium 2005; pp. B1-2-1 to B1-2-12; held on Apr. 20, 2005 by JMA.

IEEE Transactions on Magnetics, vol. 41, No. 10. Oct. 2005, pp. 3844-3846.

Abstract of Autumn Meeting of Japan Society of Powder and Powder Metallurgy, 2005; p. 143; held on Nov. 14-16, 2005.

2005 BM Symposium, Abstract of Presentation by The Japan Association of Bonded Magnet Industries held on Dec. 2, 2005.

K. D. Durst et al.; "The Coercive Field of Sintered and Melt-Spun NdFeB Magnets", Journal of Magnetism and Magnetic Materials, 68 (1987), pp. 63-75.*

International Search Report of PCT/JP2005/005134 dated Jul. 12, 2005. Associated with copending U.S. Appl. No. 10/572,753.*

Translation of Internationl Preliminary Report on Patentability mailed May 3, 2007 of International Application No. PCT/JP2005/005134. Associated with copending U.S. Appl. No. 10/572,753.*

International Search Report, dated Jun. 28, 2005, International Application No. PCT/JP2005/005134. Associated with copending U.S. Appl. No. 10/572,753.*

Copending U.S. Appl. No. 10/572,753 filed on Mar. 21, 2006.*

* cited by examiner

RARE EARTH PERMANENT MAGNET

CROSS-REFERENCE TO RELATED APPLICATION

This non-provisional application claims priority under 35 U.S.C. §119(a) on Patent Application No. 2005-084213 filed in Japan on Mar. 23, 2005, the entire contents of which are hereby incorporated by reference.

FIELD OF THE INVENTION

This invention relates to high-performance rare earth permanent magnets having a high coercive force.

BACKGROUND ART

Because of excellent magnetic properties, Nd—Fe—B permanent magnets find an ever increasing range of application. To meet the recent concern about the environmental problem, the range of utilization of magnets has spread to cover household appliances, industrial equipment, electric automobiles and wind power generators. This requires to further increase the coercive force of Nd—Fe—B magnets.

For increasing the coercive force of Nd—Fe—B magnets, there have been proposed many approaches including refinement of crystal grains, use of alloy compositions with increased Nd contents, and addition of effective elements. The current most common approach is to use alloy compositions in which Nd is partially replaced by Dy or Tb. By substituting Dy or Tb for some Nd in $Nd_2Fe_{14}B$ compound, the compound is increased in both anisotropic magnetic field and coercive force. On the other hand, the substitution with Dy or Tb results in the compound having reduced saturation magnetic polarization. Therefore, as long as it is intended to increase the coercive force by this approach, a lowering of remanence is inevitable.

In Nd—Fe—B magnets, the magnitude of an external magnetic field, which creates the nuclei of reverse magnetic domains at grain boundaries, provides a coercive force. The nucleation of reverse magnetic domains is largely affected by the structure of grain boundary, and a disorder of crystalline structure adjacent to the boundary or interface induces a disorder of magnetic structure and facilitates formation of reverse magnetic domains. Although the coercive force of Nd—Fe—B magnets reaches a theoretical maximum as high as 6 MA/m with Tb or Dy-free compositions, the magnetic field actually created by reverse magnetic domains, that is, coercive force is about 1 MA/m at best. Although it is expected that a drastic increase of coercive force be achieved by merely improving the magnetic structure adjacent to the boundary or interface, it is difficult to produce an effective form of structure for coercive force enhancement.

Under these circumstances, it was reported that when a magnet body having metallic Dy sputtered on its surface is heat treated, a high coercive force is achieved while maintaining a high remanence (residual magnetic flux density). See K. T. Park, K. Hiraga and M. Sagawa, "Effect of Metal-Coating and Consecutive Heat Treatment on Coercivity of Thin Nd—Fe—B Sintered Magnets," Proceedings of the Sixteen International Workshop on Rare-Earth Magnets and Their Applications, Sendai, p. 2.57, 2000. Relying on the same principle, an attempt was made to simplify the process by modifying the apparatus so as to enable three-dimensional sputtering (see JP-A 2004-304038). In addition to the sputtering, the rare earth metal may be fed by many techniques such as evaporation, ion plating, laser deposition, CVD, MOCVD, and plating (see JP-A 2005-011973). These techniques except the plating technique are not regarded efficient. As pointed out in JP-A 2005-011973, it is essential for this procedure that a series of steps from film formation to the end of heat treatment be carried out in a clean atmosphere containing no more than several tens of ppm of oxygen and water vapor in order to prevent the rare earth metal from oxidation and impurities from admission. The procedure is extremely unproductive as the magnet material manufacturing process.

Japanese Patent No. 3,471,876 discloses a rare earth magnet having improved corrosion resistance, comprising at least one rare earth element R, which is obtained by effecting fluorinating treatment in a fluoride gas atmosphere or an atmosphere containing a fluoride gas, to form an $RF_3$ compound or an $RO_xF_y$ compound (wherein x and y have values satisfying $0<x<1.5$ and $2x+y=3$) or a mixture thereof with R in the constituent phase in a surface layer of the magnet, and further effecting heat treatment at a temperature of 200 to 1,200° C.

JP-A 2003-282312 discloses an R—Fe—(B,C) sintered magnet (wherein R is a rare earth element, at least 50% of R being Nd and/or Pr) having improved magnetizability which is obtained by mixing an alloy powder for R—Fe—(B,C) sintered magnet with a rare earth fluoride powder so that the powder mixture contains 3 to 20% by weight of the rare earth fluoride (the rare earth being preferably Dy and/or Tb), subjecting the powder mixture to orientation in a magnetic field, compaction and sintering, whereby a primary phase is composed mainly of $Nd_2Fe_{14}B$ grains, and a particulate grain boundary phase is formed at grain boundaries of the primary phase or grain boundary triple points, said grain boundary phase containing the rare earth fluoride, the rare earth fluoride being contained in an amount of 3 to 20% by weight of the overall sintered magnet. Specifically, an R—Fe—(B,C) sintered magnet (wherein R is a rare earth element, at least 50% of R being Nd and/or Pr) is provided wherein the magnet comprises a primary phase composed mainly of $Nd_2Fe_{14}B$ grains and a grain boundary phase containing a rare earth fluoride, the primary phase contains Dy and/or Tb, and the primary phase includes a region where the concentration of Dy and/or Tb is lower than the average concentration of Dy and/or Tb in the overall primary phase.

These proposals, however, are still insufficient in producing magnets having a high coercive force.

DISCLOSURE OF THE INVENTION

An object of the present invention is to provide high-performance R—Fe—B permanent magnets (wherein R is at least two selected from rare earth elements inclusive of Sc and Y) which exhibit a high coercive force.

Regarding R—Fe—B sintered magnets (wherein R is one or more elements selected from rare earth elements inclusive of Sc and Y), typically Nd—Fe—B sintered magnets, the inventors have found that when a magnet body is heated at a temperature not higher than a sintering temperature and in such a state that the fluoride of R which is chemically stable and easy to handle may be provided from the magnet body surface, both R and fluorine are efficiently absorbed by the magnet body along grain boundaries. Specifically, Dy or Tb and F are enriched only in proximity to interfaces between grains, a grain boundary phase having Dy or Tb enriched forms a network structure continuous from the magnet surface, and Dy or Tb and F are distributed such that their concentration increases on the average from the center to the surface of the magnet body. All these features cooperate to enhance a coercive force.

Accordingly, the present invention provides a rare earth permanent magnet in the form of a sintered magnet body having an alloy composition $R^1{}_aR^2{}_bT_cA_dF_eO_fM_g$ wherein $R^1$ is at least one element selected from rare earth elements inclusive of Sc and Y and exclusive of Tb and Dy, $R^2$ is one or both of Tb and Dy, T is one or both of iron and cobalt, A is one or both of boron and carbon, F is fluorine, O is oxygen, and M is at least one element selected from the group consisting of Al, Cu, Zn, In, Si, P, S, Ti, V, Cr, Mn, Ni, Ga, Ge, Zr, Nb, Mo, Pd, Ag, Cd, Sn, Sb, Hf, Ta, and W, a through g indicative of atom percents of the corresponding elements in the alloy have values in the range: $10 \leqq a+b \leqq 15$, $3 \leqq d \leqq 15$, $0.01 \leqq e \leqq 4$, $0.04 \leqq f \leqq 4$, $0.01 \leqq g \leqq 11$, the balance being c, said magnet body having a center and a surface. Constituent elements F and $R^2$ are distributed such that their concentration increases on the average from the center toward the surface of the magnet body. Grain boundaries having a concentration of $R^2/(R^1+R^2)$ which is on the average higher than the concentration of $R^2/(R^1+R^2)$ contained in primary phase grains of $(R^1,R^2)_2T_{14}A$ tetragonal system form a three-dimensional network structure which is continuous from the magnet body surface to a depth of at least 10 μm.

In a preferred embodiment, the oxyfluoride of $(R^1,R^2)$ is present at the grain boundaries in a grain boundary region that extends from the magnet body surface to a depth of at least 20 μm, and particles of the oxyfluoride having an equivalent circle diameter of at least 1μm are distributed in the grain boundary region at a population of at least 2,000 particles/$mm^2$, and the oxyfluoride is present in an area fraction of at least 1%.

In a preferred embodiment, the oxyfluoride of $(R^1,R^2)$ at grain boundaries contains Nd and/or Pr, and an atomic ratio of Nd and/or Pr to $(R^1+R^2)$ contained in the oxyfluoride at grain boundaries is higher than an atomic ratio of Nd and/or Pr to $(R^1+R^2)$ contained at grain boundaries excluding the oxyfluoride and the oxide of $R^3$ wherein $R^3$ is at least one element selected from rare earth elements inclusive of Sc and Y.

In preferred embodiments, $R^1$ comprises at least 10 atom % of Nd and/or Pr; T comprises at least 60 atom % of iron; and A comprises at least 80 atom % of boron.

The present invention is successful in providing R—Fe—B sintered magnets which exhibit a high coercive force.

DESCRIPTION OF THE PREFERRED EMBODIMENTS

Figure 1:
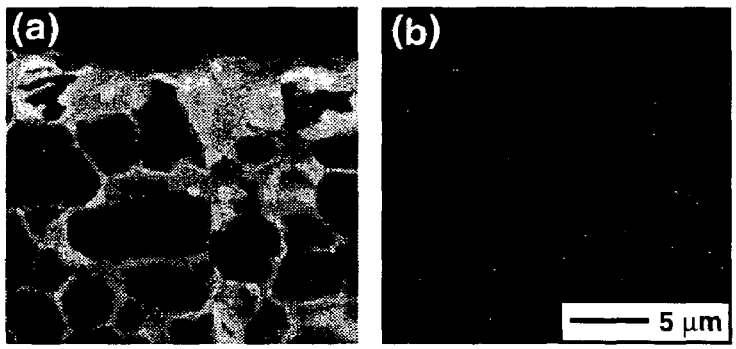
FIGS. 1*a* and 1*b* are photomicrographs showing a Dy distribution image in a magnet body M1 manufactured in Example 1 and a Dy distribution image in a magnet body P1 as machined and heat treated, respectively.

The rare earth permanent magnet of the present invention is in the form of a sintered magnet body having an alloy composition of the formula (1).

$$R^1_aR^2_bT_cA_dF_eO_fM_g \quad (1)$$

Herein $R^1$ is at least one element selected from rare earth elements inclusive of Sc and Y and exclusive of Tb and Dy, $R^2$ is one or both of Tb and Dy, T is one or both of iron (Fe) and cobalt (Co), A is one or both of boron and carbon, F is fluorine, O is oxygen, and M is at least one element selected from the group consisting of Al, Cu, Zn, In, Si, P, S, Ti, V, Cr, Mn, Ni, Ga, Ge, Zr, Nb, Mo, Pd, Ag, Cd, Sn, Sb, Hf, Ta, and W. The subscripts a through g indicative of atom percents of the corresponding elements in the alloy have values in the range: $10 \leqq a+b \leqq 15$, $3 \leqq d \leqq 15$, $0.01 \leqq e \leqq 4$, $0.04 \leqq f \leqq 4$, $0.01 \leqq g \leqq 11$, the balance being c.

Specifically, $R^1$ is selected from among Sc, Y, La, Ce, Pr, Nd, Sm, Eu, Gd, Ho, Er, Yb, and Lu. Desirably, $R^1$ contains Nd and/or Pr as a main component, the content of Nd and/or Pr being preferably at least 10 atom %, more preferably at least 50 atom % of $R^1$. $R^2$ is one or both of Tb and Dy.

The total amount (a+b) of $R^1$ and $R^2$ is 10 to 15 atom %, as recited above, and preferably 12 to 15 atom %. The amount (b) of $R^2$ is preferably 0.01 to 8 atom %, more preferably 0.05 to 6 atom %, and even more preferably 0.1 to 5 atom %.

The amount (c) of T, which is Fe and/or Co, is preferably at least 60 atom %, and more preferably at least 70 atom %. Although cobalt can be omitted (i.e., 0 atom %), cobalt may be included in an amount of at least 1 atom %, preferably at least 3 atom %, more preferably at least 5 atom % for improving the temperature stability of remanence or other purposes.

Preferably A, which is boron and/or carbon, contains at least 80 atom %, more preferably at least 85 atom % of boron. The amount (d) of A is 3 to 15 atom %, as recited above, preferably 4 to 12 atom %, and more preferably 5 to 8 atom %.

The amount (e) of fluorine is 0.01 to 4 atom %, as recited above, preferably 0.02 to 3.5 atom %, and more preferably 0.05 to 3.5 atom %. At too low a fluorine content, an enhancement of coercive force is not observable. Too high a fluorine content alters the grain boundary phase, leading to a reduced coercive force.

The amount (f) of oxygen is 0.04 to 4 atom %, as recited above, preferably 0.04 to 3.5 atom %, and more preferably 0.04 to 3 atom %.

The amount (g) of other metal element M is 0.01 to 11 atom %, as recited above, preferably 0.01 to 8 atom %, and more preferably 0.02 to 5 atom %. The other metal element M may be present in an amount of at least 0.05 atom %, and especially at least 0.1 atom %.

It is noted that the sintered magnet body has a center and a surface. In the invention, constituent elements F and $R^2$ are distributed in the sintered magnet body such that their concentration increases on the average from the center of the magnet body toward the surface of the magnet body. Specifically, the concentration of F and $R^2$ is highest at the surface of the magnet body and gradually decreases toward the center of the magnet body. Fluorine may be absent at the magnet body center although the invention prefers that the oxyfluoride of $R^1$ and $R^2$, typically $(R^1_{1-x}R^2_x)OF$ (wherein x is a number of 0 to 1) be present at grain boundaries in a grain boundary region that extends from the magnet body surface to a depth of at least 20 μm. While grain boundaries surround primary phase grains of $(R^1,R^2)_2T_{14}A$ tetragonal system within the sintered magnet body, the concentration of $R^2/(R^1+R^2)$ contained in the grain boundaries is on the average higher than the concentration of $R^2/(R^1+R^2)$ contained in the primary phase grains. The grain boundaries having a concentration of $R^2/(R^1+R^2)$ which is on the average higher than the concentration of $R^2/(R^1+R^2)$ contained in the primary phase grains should form a three-dimensional network structure which is continuous from the magnet body surface to a depth of 10μm, more preferably to a depth of 13 μm, even more preferably to a depth of 16 μm. It ensures a high coercive force that the grain boundaries form a continuous three-dimensional network structure having a high $R^2$ concentration.

In a preferred embodiment, the oxyfluoride of $(R^1,R^2)$ is present at grain boundaries in a grain boundary region that extends from the magnet body surface to a depth of at least 20 μm. Particles of the oxyfluoride having an equivalent circle diameter of at least 1μm should preferably be distributed in the grain boundary region at a population of at least 2,000 particles/$mm^2$, more preferably at least 3,000 particles/$mm^2$, most preferably 4,000 to 20,000 particles/$mm^2$. The oxyfluoride should preferably be present in an area fraction of at least 1%, more preferably at least 2%, most preferably 2.5 to 10%. The number and area fraction of particles are determined by taking a compositional distribution image by electron probe microanalysis (EPMA), processing the image, and counting oxyfluoride particles having an equivalent circle diameter of at least 1μm.

In a further preferred embodiment, the oxyfluoride of ($R^1$, $R^2$) present at grain boundaries contains Nd and/or Pr, and an atomic ratio of Nd and/or Pr to ($R^1$+$R^2$) contained in the oxyfluoride at grain boundaries is higher than an atomic ratio of Nd and/or Pr to ($R^1$+$R^2$) contained at grain boundaries excluding the oxyfluoride and the oxide of $R^3$ wherein $R^3$ is at least one element selected from rare earth elements inclusive of Sc and Y.

The rare earth permanent magnet of the invention can be manufactured by feeding a powder containing $R^2$ and fluorine components to the surface of an R—Fe—B sintered magnet body, and causing the magnet body to absorb the components. The R—Fe—B sintered magnet body, in turn, can be manufactured by a conventional process including crushing a mother alloy, milling, compacting and sintering.

The mother alloy used herein contains R, T, A, and M. R is at least one element selected from rare earth elements inclusive of Sc and Y. R is typically selected from among Sc, Y, La, Ce, Pr, Nd, Sm, Eu, Gd, Tb, Dy, Ho, Er, Yb, and Lu. Desirably, R contains Nd, Pr and Dy as main components. These rare earth elements inclusive of Sc and Y are preferably present in an amount of 10 to 15 atom %, more preferably 12 to 15 atom % of the overall alloy. More desirably, R contains one or both of Nd and Pr in an amount of at least 10 atom %, especially at least 50 atom % of the entire R. T is one or both of Fe and Co, and Fe is preferably contained in an amount of at least 50 atom %, and more preferably at least 65 atom % of the overall alloy. A is one or both of boron and carbon, and boron is preferably contained in an amount of 2 to 15 atom %, and more preferably 3 to 8 atom % of the overall alloy. M is at least one element selected from the group consisting of Al, Cu, Zn, In, Si, P, S, Ti, V, Cr, Mn, Ni, Ga, Ge, Zr, Nb, Mo, Pd, Ag, Cd, Sn, Sb, Hf, Ta, and W. M may be contained in an amount of 0.01 to 11 atom %, and preferably 0.1 to 5 atom % of the overall alloy. The balance is composed of incidental impurities such as N and O.

The mother alloy is prepared by melting metal or alloy feeds in vacuum or an inert gas atmosphere, typically argon atmosphere, and casting the melt into a flat mold or book mold or strip casting. A possible alternative is a so-called two-alloy process involving separately preparing an alloy approximate to the $R_2Fe_{14}B$ compound composition constituting the primary phase of the relevant alloy and an R-rich alloy serving as a liquid phase aid at the sintering temperature, crushing, then weighing and mixing them. Notably, the alloy approximate to the primary phase composition is subjected to homogenizing treatment, if necessary, for the purpose of increasing the amount of the $R_2Fe_{14}B$ compound phase, since α-Fe is likely to be left depending on the cooling rate during casting and the alloy composition. The homogenizing treatment is a heat treatment at 700 to 1,200° C. for at least one hour in vacuum or in an Ar atmosphere. To the R-rich alloy serving as a liquid phase aid, a so-called melt quenching or strip casting technique is applicable as well as the above-described casting technique.

The mother alloy is generally crushed to a size of 0.05 to 3 mm, preferably 0.05 to 1.5 mm. The crushing step uses a Brown mill or hydriding pulverization, with the hydriding pulverization being preferred for those alloys as strip cast. The coarse powder is then finely divided to a size of generally 0.2 to 30μm, preferably 0.5 to 20 μm, for example, by a jet mill using nitrogen under pressure. The oxygen content of the sintered body can be controlled by admixing a minor amount of oxygen with the pressurized nitrogen at this point. The oxygen content of the final sintered body, which is given as the oxygen introduced during the preparation of the ingot plus the oxygen taken up during transition from the fine powder to the sintered body, is preferably 0.04 to 4 atom %, more preferably 0.04 to 3.5 atom %.

The fine powder is then compacted under a magnetic field on a compression molding machine and placed in a sintering furnace. Sintering is effected in vacuum or in an inert gas atmosphere usually at a temperature of 900 to 1,250° C., preferably 1,000 to 1,100° C. The thus sintered magnet contains 60 to 99 vol %, preferably 80 to 98 vol % of the tetragonal $R_2Fe_{14}B$ compound as a primary phase, the balance being 0.5 to 20 vol % of an R-rich phase, 0 to 10 vol % of a B-rich phase, 0.1 to 10 vol % of R oxide, and at least one of carbides, nitrides and hydroxides of incidental impurities or a mixture or composite thereof.

The sintered magnet body (or sintered block) is machined to a predetermined shape, on which absorptive treatment is carried out to produce a form of magnet according to the invention. As described above, the magnet of the invention is obtained by causing the magnet body to absorb $R^2$ and fluorine atoms. The fluoride of $R^2$ may be used to this end because the fluoride of $R^2$ is chemically stable as compared with a metallic form of $R^2$, especially a metallic thin film of $R^2$, and does not undergo any chemical change even when comminuted into fine particles. The use of $R^2$ fluoride in powder form is advantageous because it can be supplied directly to the magnet body without a need for a special apparatus as required for sputtering. For its preparation, the fluoride of $R^2$ does not require a clean atmosphere or a special apparatus requiring careful operation such as a globe box. Accordingly, the magnet of the invention can be manufactured at a high productivity.

In one typical example, a powder containing the fluoride of $R^2$ is mixed with a liquid such as alcohol to form a slurry, which is applied to the surface of the magnet body. The liquid is evaporated off, leaving the magnet body packed with the fluoride powder. The magnet body packed with the fluoride powder is heat treated in vacuum or in an atmosphere of inert gas such as Ar or He at a temperature of not higher than the sintering temperature (referred to as Ts), preferably 200° C. to (Ts-5)° C., especially 250° C. to (Ts-10)° C. for about 0.5 to 100 hours, preferably about 1 to 50 hours. Through the heat treatment, $R^2$ and fluorine are infiltrated in the magnet and the oxide of $R^1$ within the sintered magnet body reacts with fluorine to make a chemical change into an oxyfluoride.

The oxyfluoride of R (rare earth elements inclusive of Sc and Y) within the magnet is typically ROF, although it generally denotes oxyfluorides containing R, oxygen and fluorine that can achieve the effect of the invention including $RO_mF_n$ (wherein m and n are positive numbers) and modified or stabilized forms of $RO_mF_n$ wherein part of R is replaced by a metal element.

The amount of fluorine absorbed in the magnet body at this point varies with the composition and particle size of the powder used, the proportion of the powder occupying the magnet surface-surrounding space during the heat treatment, the specific surface area of the magnet, the temperature and time of the heat treatment although the absorbed fluorine amount is preferably 0.01 to 4 atom %, more preferably 0.05 to 3.5 atom %. The absorbed fluorine amount is further preferably 0.02 to 3.5 atom %, especially 0.05 to 3.5 atom % in order that particles of the oxyfluoride having an equivalent circle diameter of at least 1 μm be distributed along the grain boundaries at a population of at least 2,000 particles/$mm^2$, more preferably at least 3,000 particles/$mm^2$. For absorption, fluorine is fed to the surface of the sintered magnet body in an amount of preferably 0.03 to 30 mg/$cm^2$, more preferably 0.15 to 15 mg/$cm^2$ of the surface.

As described above, in a region that extends from the magnet body surface to a depth of at least 20 μm, particles of the oxyfluoride having an equivalent circle diameter of at least 1 μm are distributed at grain boundaries at a population of at least 2,000 particles/mm$^2$. The depth from the magnet body surface of the region where the oxyfluoride is present can be controlled by the concentration of oxygen in the magnet body. In this regard, it is recommended that the concentration of oxygen contained in the magnet body be 0.04 to 4 atom %, more preferably 0.04 to 3.5 atom %, most preferably 0.04 to 3 atom %. If the depth from the magnet body surface of the region where the oxyfluoride is present, the particle diameter of the oxyfluoride, and the population of the oxyfluoride are outside the above-specified ranges, undesirably the electric resistivity of the magnet body could not be effectively increased.

Through the heat treatment, the $R^2$ component is also enriched adjacent to grain boundaries. The total amount of $R^2$ component absorbed in the magnet body is preferably 0.005 to 2 atom %, more preferably 0.01 to 2 atom %, even more preferably 0.02 to 1.5 atom %. For absorption, the $R^2$ component is fed to the surface of the magnet body in a total amount of preferably 0.07 to 70 mg/cm$^2$, more preferably 0.35 to 35 mg/cm$^2$ of the surface. This ensures that continuous three-dimensional network grain boundaries having a high $R^2$ concentration form to a depth of at least 10 μm, especially at least 13 μm, more especially at least 16 μm from the surface.

The permanent magnet material thus obtained can be used as a high-performance permanent magnet in various applications including motors and pickup actuators.

EXAMPLE

Examples of the present invention are given below by way of illustration and not by way of limitation.

Example 1 and Comparative Example 1

An alloy in thin plate form was prepared by using Nd, Al, and Fe metals of at least 99 wt % purity and ferroboron, weighing predetermined amounts of them, high-frequency melting them in an Ar atmosphere, and casting the melt onto a single chill roll of copper (strip casting technique). The alloy consisted of 13.5 atom % Nd, 0.5 atom % Al, 5.8 atom % B, and the balance of Fe. It is designated alloy A.

Separately, an alloy in ingot form was prepared by using Nd, Tb, Fe, Co, Al, and Cu metals of at least 99 wt % purity and ferroboron, weighing predetermined amounts of them, high-frequency melting them in an Ar atmosphere, and casting the melt in a flat mold. The alloy consisted of 20 atom % Nd, 10 atom % Tb, 24 atom % Fe, 6 atom % B, 1 atom % Al, 2 atom % Cu, and the balance of Co. It is designated alloy B.

These alloys were ground to a size of under 30 mesh, by hydriding pulverization for alloy A and by crushing in a nitrogen atmosphere on a jaw crusher and a Brown mill in sequence for alloy B.

Subsequently, the powders of alloys A and B were weighed and mixed in a ratio of 92 wt % to 8 wt %. On a jet mill using nitrogen gas under pressure, the powder mixture was finely divided into a powder with a mass base median diameter of 4.1 μm. The fine powder was oriented in a magnetic field of 15 kOe under a nitrogen atmosphere and compacted under-a pressure of about 1 ton/cm$^2$. The compact was then placed in a sintering furnace with an Ar atmosphere where it was sintered at 1,060° C. for 2 hours, obtaining a magnet block. Using a diamond cutter, the magnet block was machined on all the surfaces to dimensions of 10 mm×10 mm×2 mm thick. The magnet body was successively washed with alkaline solution, deionized water, nitric acid and deionized water, and dried.

Next, dysprosium fluoride powder having an average particle size of 2 μm was mixed with ethanol in a weight fraction of 50% to form a slurry. The slurry was spray coated to the entire surfaces of the magnet body. The coated magnet body was dried in air. The amount of dysprosium fluoride fed was 3.3 mg/cm$^2$. Thereafter, the packed magnet body was subjected to absorptive treatment in an Ar atmosphere at 800° C. for 10 hours and then aging treatment at 500° C. for 1 hour and quenched, obtaining a magnet body within the scope of the invention. This magnet body is designated Ml. For comparison purposes, a magnet body was similarly prepared by effecting heat treatment without the dysprosium fluoride package. This is designated P1.

The magnet bodies M1 and P1 were measured for magnetic properties (remanence Br, coercive force Hcj, (BH)max), with the results shown in Table 2. The compositions of the magnets are shown in Table 3. The magnet M1 of the invention marked a coercive force increase of 425 kAm$^{-1}$ relative to the coercive force of the magnet P1 having undergone heat treatment without the dysprosium fluoride package while showing a remanence decline of 5 mT.

The magnet bodies M1 and P1 were analyzed by electron probe microanalysis (EPMA), with their Dy distribution images being shown in FIGS. 1*a* and 1*b*. Since the source alloy for the magnet is free of Dy, bright contrast spots indicative of the presence of Dy are not found in the image of P1. In contrast, the magnet M1 having undergone absorptive treatment with the dysprosium fluoride package manifests that Dy is enriched only at grain boundaries and that the grain boundary phase having Dy enriched is distributed as a three-dimensional network continuous from the surface of the magnet body to a depth of 40 μm. FIG. 1*a* illustrates a Dy distribution image adjacent to the surface. For the magnet M1 having Dy absorbed therein, average concentrations of Dy and F were computed from analysis of the distribution images. Table 1 shows how the concentrations of Dy and F change depthwise from the magnet body surface. It is seen that the concentrations of Dy and F enriched along grain boundaries become lower at more inward positions within the magnet.

Figure 2:
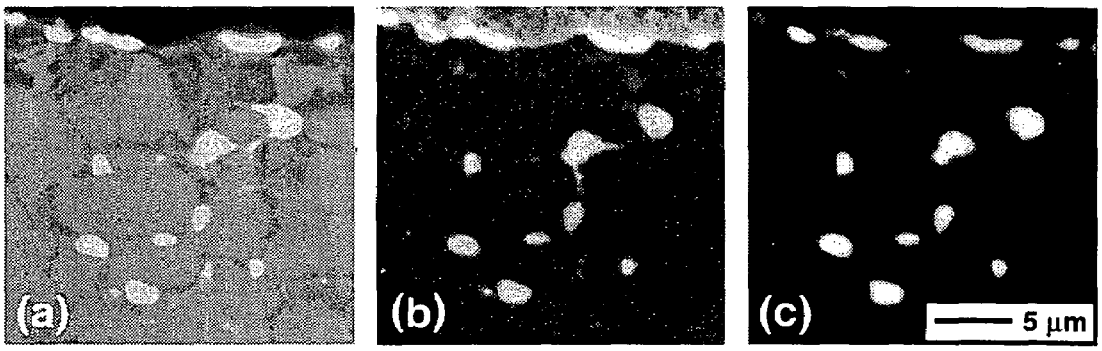
FIGS. 2*a*, 2*b*, and 2*c* are photomicrographs showing compositional distribution images of Nd, O, and F in the magnet body M1 of Example 1, respectively.

FIG. 2 illustrates distribution images of Nd, O and F under the same field of view as in FIG. 1. It is understood that fluorine once absorbed reacts with neodymium oxide already present within the magnet to form neodymium oxyfluoride. A number of NdOF particles are distributed in the surface layer. In this region, those NdOF particles having an equivalent circle diameter of at least 1 μm had a population of 5,000 particles/mm$^2$ and an area fraction of 4.7%.

TABLE 1

| Distance from magnet surface, μm | Average Dy concentration, mass % | Average F concentration, mass % |
|---|---|---|
| 10 | 6.1 | 2.1 |
| 20 | 5.3 | 1.6 |
| 50 | 2.4 | 0.3 |
| 100 | 1.3 | 0.1 |
| 200 | 0.8 | <0.1 |
| 500 | 0.3 | <0.1 |

Example 2 and Comparative Example 2

An alloy in thin plate form was prepared by using Nd, Pr, Co, Al, and Fe metals of at least 99 wt % purity and ferroboron, weighing predetermined amounts of them, high-frequency melting them in an Ar atmosphere, and casting the melt onto a single chill roll of copper (strip casting technique). The alloy consisted of 11.5 atom % Nd, 2.0 atom % Pr, 1.0 atom % Co, 0.5 atom % Al, 5.8 atom % B, and the balance of Fe. It is designated alloy A.

Separately, an alloy in ingot form was prepared by using Nd, Dy, Fe, Co, Al, and Cu metals of at least 99 wt % purity and ferroboron, weighing predetermined amounts of them, high-frequency melting them in an Ar atmosphere, and casting the melt in a flat mold. The alloy consisted of 20 atom % Nd, 10 atom % Dy, 24 atom % Fe, 6 atom % B, 1 atom % Al, 2 atom % Cu, and the balance of Co. It is designated alloy B.

These alloys were ground to a size of under 30 mesh, by hydriding pulverization for alloy A and by crushing in a nitrogen atmosphere on a jaw crusher and a Brown mill in sequence for alloy B.

Subsequently, the powders of alloys A and B were weighed and mixed in a ratio of 92 wt % to 8 wt %. On a jet mill using nitrogen gas under pressure, the powder mixture was finely divided into a powder with a mass base median diameter of 3.9 μm. The fine powder was oriented in a magnetic field of 15 kOe under a nitrogen atmosphere and compacted under a pressure of about 1 ton/cm$^2$. The compact was then placed in a sintering furnace with an Ar atmosphere where it was sintered at 1,050° C. for 2 hours, obtaining a magnet block. Using a diamond cutter, the magnet block was machined on all the surfaces to dimensions of 10 mm×10 mm×3 mm thick. The magnet body was successively washed with alkaline solution, deionized water, nitric acid and deionized water, and dried.

Next, terbium fluoride powder having an average particle size of 2 μm was mixed with ethanol in a weight fraction of 50% to form a slurry. The slurry was spray coated to the entire surfaces of the magnet body. The coated magnet body was dried in air. The amount of terbium fluoride fed was 5.1 mg/cm$^2$. Thereafter, the packed magnet body was subjected to absorptive treatment in an Ar atmosphere at 800° C. for 15 hours and then aging treatment at 500° C. for 1 hour and quenched, obtaining a magnet body within the scope of the invention. This magnet body is designated M2. For comparison purposes, a magnet body was similarly prepared by effecting heat treatment without the terbium fluoride package. This is designated P2.

The magnet bodies M2 and P2 were measured for magnetic properties (Br, Hcj, (BH)max), with the results shown in Table 2. The compositions of the magnets are shown in Table 3. The magnet M2 of the invention marked a coercive force increase of 760 kAm$^{-1}$ relative to the coercive force of the magnet P2 having undergone heat treatment without the terbium fluoride package while showing a remanence decline of 5 mT. The Tb and F distribution images of the magnet body M2 by EPMA were equivalent to the Dy distribution and F images in Example 1. The concentration distributions of elements in the surface layer of the magnet body M2 were analyzed by EPMA, finding that a number of ROF particles were present in the same form as in Example 1.

Example 3 and Comparative Example 3

An alloy in thin plate form was prepared by using Nd, Al, Cu, and Fe metals of at least 99 wt % purity and ferroboron, weighing predetermined amounts of them, high-frequency melting them in an Ar atmosphere, and casting the melt onto a single chill roll of copper (strip casting technique). The alloy consisted of 13.2 atom % Nd, 0.5 atom % Al, 0.3 atom % Cu, 5.8 atom % B, and the balance of Fe.

The alloy was ground to a size of under 30 mesh by the hydriding technique. On a jet mill using nitrogen gas under pressure, the coarse powder was finely divided into a powder with a mass base median diameter of 4.4 μm. The fine powder was oriented in a magnetic field of 15 kOe under a nitrogen atmosphere and compacted under a pressure of about 1 ton/cm$^2$. The compact was then placed in a sintering furnace with an Ar atmosphere where it was sintered at 1,060° C. for 2 hours, obtaining a magnet block. Using a diamond cutter, the magnet block was machined on all the surfaces to dimensions of 3 mm×3 mm×3 mm thick. The magnet body was successively washed with alkaline solution, deionized water, nitric acid and deionized water, and dried.

Next, terbium fluoride powder having an average particle size of 2 μm was mixed with deionized water in a weight fraction of 50% to form a slurry. The magnet body was immersed in the slurry for 1 minute while sonicating the slurry, taken up and immediately dried with hot air. The amount of terbium fluoride fed was 1.8 mg/cm$^2$. The magnet body packed with terbium fluoride powder was subjected to absorptive treatment in an Ar atmosphere at 900° C. for 2 hours and then aging treatment at 500° C. for 1 hour and quenched, obtaining a magnet body within the scope of the invention. This magnet body is designated M3. For comparison purposes, a magnet body was similarly prepared by effecting heat treatment without the terbium fluoride package. This is designated P3.

The magnet bodies M3 and P3 were measured for magnetic properties (Br, Hcj, (BH)max), with the results shown in Table 2. The compositions of the magnets are shown in Table 3. The magnet M3 of the invention marked a coercive force increase of 730 kAm$^{-1}$ relative to the coercive force of the magnet P3 having undergone heat treatment without the terbium fluoride package while showing a remanence decline of 5 mT. The Tb and F distribution images of the magnet body M3 by EPMA were equivalent to the Dy distribution and F images in Example 1. The concentration distributions of elements in the surface layer of the magnet body M3 were analyzed by EPMA, finding that a number of ROF particles were present in the same form as in Example 1.

Example 4 and Comparative Example 4

An alloy in thin plate form was prepared by using Nd, Pr, Al, Cu, Zr, and Fe metals of at least 99 wt % purity and ferroboron, weighing predetermined amounts of them, high-frequency melting them in an Ar atmosphere, and casting the melt onto a single chill roll of copper (strip casting technique). The alloy consisted of 11.0 atom % Nd, 2.2 atom % Pr, 0.5 atom % Al, 0.3 atom % Cu, 0.2 atom % Zr, 6.0 atom % B, and the balance of Fe.

The alloy was ground to a size of under 30 mesh by the hydriding technique. On a jet mill using nitrogen gas under pressure, the coarse powder was finely divided into a powder with a mass base median diameter of 3.8 μm. The fine powder was oriented in a magnetic field of 15 kOe under a nitrogen atmosphere and compacted under a pressure of about 1 ton/cm$^2$. The compact was then placed in a sintering furnace with an Ar atmosphere where it was sintered at 1,070° C. for 2 hours, obtaining a magnet block. Using a diamond cutter, the magnet block was machined on all the surfaces to dimensions of 5 mm×5 mm×2 mm thick. The magnet body was successively washed with alkaline solution, deionized water, nitric acid and deionized water, and dried.

Next, terbium fluoride, dysprosium fluoride and neodymium oxide in powder form were weighed and mixed in a weight fraction of 40%, 30% and 30%. The terbium fluoride, dysprosium fluoride and neodymium oxide powders had an average particle size of 2 μm, 10 μm, and 1 μm, respectively. The powder mixture was mixed with ethanol in a weight fraction of 50% to form a slurry. The magnet body was immersed in the slurry for 1 minute while sonicating the slurry, taken up and immediately dried with hot air. The total amount of terbium fluoride and dysprosium fluoride fed was 2.9 mg/cm$^2$. The magnet body packed with the powder was subjected to absorptive treatment in an Ar atmosphere at 850° C. for 8 hours and then aging treatment at 500° C. for 1 hour and quenched, obtaining a magnet body within the scope of the invention. This magnet body is designated M4. For comparison purposes, a magnet body was similarly prepared by effecting heat treatment without the powder package. This is designated P4.

The magnet bodies M4 and P4 were measured for magnetic properties (Br, Hcj, (BH)max), with the results shown in Table 2. The magnet M4 of the invention marked a coercive force increase of 570 $kAm^{-1}$ relative to the coercive force of the magnet P4 having undergone heat treatment without the fluoride package while showing a remanence decline of 5 mT. The concentration distributions of elements in the surface layer of the magnet body M4 were analyzed by EPMA, finding that a number of ROF particles were present in the same form as in Example 1.

Examples 5-9 and Comparative Examples 5-9

An alloy in thin plate form was prepared by using Nd, Pr, Al, Cu, Ta, Sn, Ga, Mn, Hf, and Fe metals of at least 99 wt % purity and ferroboron, weighing predetermined amounts of them, high-frequency melting them in an Ar atmosphere, and casting the melt onto a single chill roll of copper (strip casting technique). The alloy consisted of 11.0 atom % Nd, 2.2 atom % Pr, 0.5 atom % Al, 0.3 atom % Cu, 6.0 atom % B, 0.7 atom % M', and the balance of Fe. Note that M' is any one of Ta, Sn, Ga, Mn, and Hf.

The alloy was ground to a size of under 30 mesh by the hydriding technique. On a jet mill using nitrogen gas under pressure, the coarse powder was finely divided into a powder with a mass base median diameter of 3.9-4.3 μm. The fine powder was oriented in a magnetic field of 15 kOe under a nitrogen atmosphere and compacted under a pressure of about 1 $ton/cm^2$. The compact was then placed in a sintering furnace with an Ar atmosphere where it was sintered at 1,060° C. for 2 hours, obtaining a magnet block. Using a diamond cutter, the magnet block was machined on all the surfaces to dimensions of 20 mm×20 mm×3 mm thick. The magnet body was successively washed with alkaline solution, deionized water, citric acid and deionized water, and dried.

Next, terbium fluoride powder having an average particle size of 2 μm was mixed with ethanol in a weight fraction of 50% to form a slurry. The magnet body was immersed in the slurry for 1 minute while sonicating the slurry, taken up and immediately dried with hot air. The amount of terbium fluoride fed was 2.1 $mg/cm^2$. The magnet body packed with the powder was subjected to absorptive treatment in an Ar atmosphere at 800° C. for 8 hours and then aging treatment at 500° C. for 1 hour and quenched, obtaining a magnet body within the scope of the invention. These magnet bodies are designated M5 to M9 in the order of M'=Ta, Sn, Ga, Mn, and Hf. For comparison purposes, magnet bodies were similarly prepared by effecting heat treatment without the powder package. They are designated P5 to P9.

The magnet bodies M5 to M9 and P5 to P9 were measured for magnetic properties (Br, Hcj, (BH)max), with the results shown in Table 2. The compositions of the magnets are shown in Table 3. The magnets of the invention marked a coercive force increase of 400 to 800 $kAm^{-1}$ relative to the coercive force of the magnets having undergone heat treatment without the terbium fluoride package while showing a remanence decline of approximately 5 mT. The concentration distributions of elements in the surface layer of the magnet bodies M5 to M9 were analyzed by EPMA, finding that a number of ROF particles were present in the same form as in Example 1.

TABLE 2

| | | Br (T) | Hcj (kA/m) | (BH)max ($kJ/m^3$) |
|---|---|---|---|---|
| Example 1 | M1 | 1.415 | 1450 | 392 |
| Example 2 | M2 | 1.400 | 1824 | 384 |
| Example 3 | M3 | 1.445 | 1610 | 409 |
| Example 4 | M4 | 1.435 | 1570 | 404 |
| Example 5 | M5 | 1.395 | 1600 | 381 |
| Example 6 | M6 | 1.405 | 1450 | 387 |
| Example 7 | M7 | 1.430 | 1680 | 401 |
| Example 8 | M8 | 1.395 | 1760 | 381 |
| Example 9 | M9 | 1.405 | 1530 | 387 |
| Comparative Example 1 | P1 | 1.420 | 1025 | 395 |
| Comparative Example 2 | P2 | 1.405 | 1065 | 386 |
| Comparative Example 3 | P3 | 1.450 | 880 | 412 |
| Comparative Example 4 | P4 | 1.440 | 1000 | 406 |
| Comparative Example 5 | P5 | 1.400 | 1080 | 383 |
| Comparative Example 6 | P6 | 1.415 | 1020 | 392 |
| Comparative Example 7 | P7 | 1.435 | 1160 | 403 |
| Comparative Example 8 | P8 | 1.400 | 960 | 382 |
| Comparative Example 9 | P9 | 1.410 | 1050 | 390 |

TABLE 3

| | | Pr [at. %] | Nd [at. %] | Tb [at. %] | Dy [at. %] | T [at. %] | A [at. %] | O [at. %] | F [at. %] | M* [at. %] |
|---|---|---|---|---|---|---|---|---|---|---|
| Example 1 | M1 | 0.000 | 13.684 | 0.789 | 0.165 | 77.924 | 5.763 | 0.495 | 0.486 | 0.694 |
| Example 2 | M2 | 1.990 | 11.884 | 0.142 | 0.781 | 77.898 | 5.761 | 0.412 | 0.425 | 0.693 |
| Example 3 | M3 | 0.000 | 12.804 | 0.242 | 0.000 | 78.943 | 5.712 | 0.802 | 0.709 | 0.788 |
| Example 4 | M4 | 2.130 | 10.650 | 0.141 | 0.140 | 78.394 | 5.897 | 0.840 | 0.825 | 0.983 |
| Example 5 | M5 | 2.150 | 10.752 | 0.123 | 0.000 | 78.485 | 5.954 | 0.488 | 0.360 | 1.687 |
| Example 6 | M6 | 2.150 | 10.749 | 0.142 | 0.000 | 78.459 | 5.952 | 0.445 | 0.417 | 1.686 |
| Example 7 | M7 | 2.123 | 10.617 | 0.322 | 0.000 | 77.453 | 5.879 | 0.998 | 0.941 | 1.666 |
| Example 8 | M8 | 2.146 | 10.732 | 0.121 | 0.000 | 78.336 | 5.943 | 0.682 | 0.355 | 1.684 |
| Example 9 | M9 | 2.112 | 10.562 | 0.405 | 0.000 | 77.020 | 5.849 | 1.208 | 1.187 | 1.657 |
| Comparative Example 1 | P1 | 0.000 | 13.771 | 0.796 | 0.000 | 78.434 | 5.800 | 0.501 | 0.000 | 0.698 |
| Comparative Example 2 | P2 | 2.001 | 11.950 | 0.000 | 0.797 | 78.341 | 5.793 | 0.420 | 0.000 | 0.697 |
| Comparative Example 3 | P3 | 0.000 | 12.924 | 0.000 | 0.000 | 79.711 | 5.765 | 0.805 | 0.000 | 0.795 |
| Comparative Example 4 | P4 | 2.153 | 10.766 | 0.000 | 0.000 | 79.281 | 5.962 | 0.845 | 0.000 | 0.994 |
| Comparative Example 5 | P5 | 2.161 | 10.803 | 0.000 | 0.000 | 78.864 | 5.982 | 0.495 | 0.000 | 1.695 |
| Comparative Example 6 | P6 | 2.162 | 10.809 | 0.000 | 0.000 | 78.906 | 5.985 | 0.442 | 0.000 | 1.696 |

TABLE 3-continued

| | Pr [at. %] | Nd [at. %] | Tb [at. %] | Dy [at. %] | T [at. %] | A [at. %] | O [at. %] | F [at. %] | M* [at. %] |
|---|---|---|---|---|---|---|---|---|---|
| Comparative Example 7 P7 | 2.150 | 10.749 | 0.000 | 0.000 | 78.459 | 5.952 | 1.004 | 0.000 | 1.686 |
| Comparative Example 8 P8 | 2.156 | 10.782 | 0.000 | 0.000 | 78.707 | 5.971 | 0.692 | 0.000 | 1.692 |
| Comparative Example 9 P9 | 2.145 | 10.726 | 0.000 | 0.000 | 78.290 | 5.940 | 1.216 | 0.000 | 1.683 |

*Total amount of element as M in formula (1).

Analytical values of rare earth elements were determined by entirely dissolving samples (prepared as in Examples and Comparative Examples) in aqua regia, and effecting measurement by inductively coupled plasma (ICP), analytical values of oxygen determined by inert gas fusion/infrared absorption spectroscopy, and analytical values of fluorine determined by steam distillation/Alfusone colorimetry.

Japanese Patent Application No. 2005-084213 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A rare earth permanent magnet in the form of a sintered magnet body having an alloy composition $R^1{}_aR^2{}_bT_cA_dF_eO_fM_g$ wherein $R^1$ is at least one element selected from rare earth elements inclusive of Sc and Y and exclusive of Tb and Dy, $R^2$ is one or both of Tb and Dy, T is one or both of iron and cobalt, A is one or both of boron and carbon, F is fluorine, O is oxygen, and M is at least one element selected from the group consisting of Al, Cu, Zn, In, Si, P, S, Ti, V, Cr, Mn, Ni, Ga, Ge, Zr, Nb, Mo, Pd, Ag, Cd, Sn, Sb, Hf, Ta, and W, a through g indicative of atom percents of the corresponding elements in the alloy have values in the range: $10 \leqq a+b \leqq 15$, $3 \leqq d \leqq 15$, $0.01 \leqq e \leqq 4$, $0.04 \leqq f \leqq 4$, $0.01 \leqq g \leqq 11$, the balance being c, said magnet body having a center and a surface, wherein constituent elements F and $R^2$ are distributed such that their concentration increases on the average from the center toward the surface of the magnet body, and grain boundaries having a concentration of $R^2/(R^1+R^2)$ which is on the average higher than the concentration of $R^2/(R^1+R^2)$ contained in primary phase grains of $(R^1, R^2)_2T_{14}A$ tetragonal system form a three-dimensional network structure which is continuous from the magnet body surface to a depth of at least 10 μm.

2. The rare earth permanent magnet of claim 1 wherein an oxyfluoride of $(R^1,R^2)$ is present at the grain boundaries in a grain boundary region that extends from the magnet body surface to a depth of at least 20 μm, and particles of said oxyfluoride having an equivalent circle diameter of at least 1 μm are distributed in said grain boundary region at a population of at least 2,000 particles/$mm^2$, and said oxyfluoride is present in an area fraction of at least 1%.

3. The rare earth permanent magnet of claim 1 wherein an oxyfluoride of $(R^1,R^2)$ at grain boundaries contains Nd and/or Pr, and an atomic ratio of Nd and/or Pr to $(R^1+R^2)$ contained in the oxyfluoride at grain boundaries is higher than an atomic ratio of Nd and/or Pr to $(R^1+R^2)$ contained at grain boundaries excluding the oxyfluoride and the oxide of $R^3$ wherein $R^3$ is at least one element selected from rare earth elements inclusive of Sc and Y.

4. The rare earth permanent magnet of claim 1 wherein $R^1$ comprises at least 10 atom % of Nd and/or Pr.

5. The rare earth permanent magnet of claim 1 wherein T comprises at least 60 atom % of iron.

6. The rare earth permanent magnet of claim 1 wherein A comprises at least 80 atom % of boron.

* * * * *